US012048379B2

(12) United States Patent
Kirchhoff

(10) Patent No.: US 12,048,379 B2
(45) **Date of Patent: *Jul. 30, 2024**

(54) FOAM PADDING HAVING HOLLOW VOLUMES AND A FLEXIBLE BAND

(71) Applicant: VARIOWELL DEVELOPMENT GMBH, Münster (DE)

(72) Inventor: Tobias Kirchhoff, Münster (DE)

(73) Assignee: VARIOWELL DEVELOPMENT GMBH, Muenster (DE)

( * ) Notice: Subject to any disclaimer, the term of this patent is extended or adjusted under 35 U.S.C. 154(b) by 420 days.

This patent is subject to a terminal disclaimer.

(21) Appl. No.: 16/972,809

(22) PCT Filed: May 29, 2019

(86) PCT No.: PCT/EP2019/063898

§ 371 (c)(1),
(2) Date: Dec. 7, 2020

(87) PCT Pub. No.: WO2019/238420

PCT Pub. Date: Dec. 19, 2019

(65) Prior Publication Data

US 2021/0244192 A1 Aug. 12, 2021

(30) Foreign Application Priority Data

Jun. 12, 2018 (LU) ..... 100834

(51) Int. Cl.
*A47C 21/04* (2006.01)
*A47C 27/14* (2006.01)

(52) U.S. Cl.
CPC ..... *A47C 21/046* (2013.01); *A47C 27/14* (2013.01)

(58) Field of Classification Search
CPC ..... A47C 21/046; A47C 27/14; A47C 7/746; B68G 11/04
See application file for complete search history.

(56) References Cited

U.S. PATENT DOCUMENTS 4,043,544 A * 8/1977 Ismer ..... B60N 2/5635 297/452.47
4,366,203 A * 12/1982 Briggs ..... B32B 19/041 428/319.1

(Continued)

FOREIGN PATENT DOCUMENTS

CN 103635121 A 3/2014
CN 107251247 A 10/2017

(Continued)

*Primary Examiner* — Myles A Throop
(74) *Attorney, Agent, or Firm* — Hudak, Shunk & Farine Co. LPA

(57) ABSTRACT

A foam padding (10) is disclosed. The foam padding (10) has sections (32, 34), each covering at least one hollow volume (12, 14) of the padding said padding (10) including a flexible elongated band (20) for transferring thermal energy from at least one hollow volume (12) in a first one of said sections (32) in the event of excess thermal energy towards at least one hollow volume (14) in a second section (34) in the padding (10) not containing excess thermal energy. The band (20) has a continuous electrically conducting layer (22) with a defined area extending from at least one first section (32) to another different second section (34).

23 Claims, 4 Drawing Sheets

(56) References Cited

U.S. PATENT DOCUMENTS 5,863,467 A * 1/1999 Mariner ..... H01B 1/24 264/105
5,928,548 A 7/1999 Johansson
6,794,030 B1 * 9/2004 Okada ..... H01L 23/3737 428/423.7
2001/0046449 A1 * 11/2001 Ragot ..... C22C 38/44 420/34
2005/0288749 A1 * 12/2005 Lachenbruch ..... A61F 7/10 607/108
2007/0135878 A1 * 6/2007 Lachenbruch ..... A47C 7/742 607/108
2009/0142551 A1 6/2009 Fox et al.
2010/0325796 A1 * 12/2010 Lachenbruch ..... A61F 7/10 5/422
2010/0326645 A1 * 12/2010 Fan ..... H01L 23/367 165/185
2012/0234524 A1 * 9/2012 Fan ..... B32B 9/007 165/185
2017/0164757 A1 6/2017 Thomas et al.
2017/0354190 A1 * 12/2017 Cauchy ..... A47C 7/744
2020/0326107 A1 10/2020 Makansi et al.
2021/0267382 A1 * 9/2021 Aou ..... A47C 27/002
2023/0099583 A1 * 3/2023 Kirchhoff ..... A47C 27/14 5/678

FOREIGN PATENT DOCUMENTS

DE 202005020485 U1 3/2006
PL 178869 B1 6/2000
RU 21855 U1 2/2002
WO 2006001980 A2 1/2006
WO 2015034528 A1 3/2015
WO WO-2015034528 A1 * 3/2015 ..... A47C 21/046
WO 2017066244 A1 4/2017

* cited by examiner

FOAM PADDING HAVING HOLLOW VOLUMES AND A FLEXIBLE BAND

CROSS REFERENCES TO RELATED APPLICATIONS

This patent application claims benefit to and priority of Luxembourg Patent Application No. LU100834 filed on 12 Jun. 2018 entitled "A Padding having Hollow Volumes and a Flexible Band".

FIELD OF THE INVENTION

The invention relates to a foam padding having hollow volumes and a flexible band with an electrically conducting layer and to the use of such a padding as a mattress. The flexible band with an electrically conducting layer is capable of transporting excess thermal energy from the hollow volumes in the foam padding and its surrounding material, thereby allowing e.g. to reduce temperature in certain sections of a body resting on said padding.

PRIOR ART

Various types of paddings are known. In the state of the art, paddings are known that comprise hollow volumes, usually provided for giving comfort to the padding. On example of a known padding is a so called innerspring mattresses. These innerspring mattresses have a very open air-filled space within and around the springs. In any event the spring does not have any real thermal benefit and at least does not extent from one hollow volume or space to another. In foam-based paddings the hollow volumes will be much smaller and indeed one section of the padding will cover many of such hollow spaces.

Some mattresses have been proposed in the art which use cooling or heating fluid or propelled air. However, those approaches have proven to be unpractical.

Another example of a padding is known from US Patent Publication No. US2015/034528 (Tempur-Pedic) which describes a cushion for prolonged cooling that includes a region with a phase change material and an underlying copper layer connected to another region of phase change material. The phase change materials are filled with paraffin wax melting at certain predetermined temperature and thereby absorbing thermal energy. At the moment of melting, this phase change material feels 'cool'. Naturally after melting the phase change is no longer able to absorb thermal energy. The patent application teaches an attempt to extend the duration of the melting phase by transporting thermal energy away from the phase change material by connecting this phase change material with a copper band located under the bottom of this phase change material, whereas the body heat is absorbed into the phase change material from the top of the phase change material.

Considering the temperature alone, the concept described in this '528 patent application appears plausible, as the phase change material feels 'cool' and a copper band can transport thermal energy. However, the deficiencies in the patent application are revealed when the flow of thermal energy is analyzed. The body heat emits thermal energy which cross into the phase change material. It is known that there will be a certain resistance for thermal energy to cross into the phase change material. Then this thermal energy must pass through the phase change material to reach the copper band. However, the paraffin wax used in the phase change material has an extremely low thermal conductivity (between 0.2-0.8 $Wm^{-1}$ $K^{-1}$), whereas the copper of the metal band has a thermal conductivity of 401 $Wm^{-1}$ $K^{-1}$. Due to the low thermal connectivity of the paraffin wax, the thermal energy will not reach this copper band at all or only to a very low extent. The document teaches that this copper band should be connected to another area to which the thermal energy has to flow. The phase change material is also located in that area, and the thermal energy needs to cross more of the phase change material again.

Analyzing this setup leads to the conclusion that the flow of thermal energy will be extremely small, much of the thermal energy will only be absorbed by the first phase change material by itself until that phase change material melts. The phase change material can absorb only up to 9 KJ/KG.

Furthermore, the phase change material has no flexibility so the phase change material can only be used in small quantities without diminishing comfort of the mattress.

It is known that the body emits about 230 KJ of thermal energy during an eight-hour period. Therefore, it can be calculated that the phase change material will have melted after approximately 20 to 30 minutes. After the phase change material has completely melted, then the construction of the mattress is more or less insulating with a thermal conductivity of 0.2-0.8 $Wm^{-1}$ $K^{-1}$ Another example is U.S. Pat. No. 4,043,544 (Ismer) which discloses a pad for seats or mattresses comprising a pad body of plastic material with recess means therein and a covering layer overlaying the pad body, strips of reinforcing material sandwiched between the pad body and the covering layer and at least selected ones of the stripes being in alignment with the recess means. Heat is dissipated from the covering layer through the recess means and the pad is reinforced by said stripes.

This document solves the problem that recesses cut into foams may be completely closed under body pressure, so the air inside the recesses is unable to move and will heat up. The document describes a method to prevent the recesses from collapsing under body pressure by reinforcing the recesses with steel bands. The thermal energy load is still described as flowing through the recesses and not through the steel bands. The flow of thermal energy is activated by 'pumping' behavior of the air within the recesses by movement of the body. There is no flow of thermal energy without movement of the body. As there is no definition of the positioning of the metal bands, the metal bands will only by chance transport thermal energy by itself. Furthermore, the patent teaches that plastic plates should be integrated into each crossing point of the steel bands, thereby reducing any chance flow of thermal energy to almost nothing.

None of the foam paddings described in the art have been practical and there is therefore a need for an improved foam padding that can improve the comfort of a user of such a foam padding

SUMMARY OF THE INVENTION

The invention provides for an improved padding as defined in the independent claim, preferred embodiments are defined in the dependent claims. According to one aspect of the invention a padding is provided with a band which if positioned as claimed, allows to at least locally reduce temperature in a padding, such as a mattress so that the user feels more comfortable. Unlike state of the art invention to solve the problem of overheating of a user of mattresses (being most likely made from at least some Polyurethane foam) this invention is not using air as the medium to move thermal energy. Using air (i.e. with ventilators or air channels cut into foam) will mostly trigger the air to move upwards, towards the user. Also, this invention is not using material to absorb thermal energy (i.e. PCM's, Gel) as a typical use situation of a mattress is sleeping on a mattress for an extended time, typically several hours. Any material just absorbing thermal energy would be thermally exhausted long before finishing use, as the body heat is emitting consistently a high amount of thermal energy during use.

This invention is based on research and many tests performed to invent a solution where the thermal energy load is in fact transported and not just stored, this solution being mechanically flexible as not to impact the comfort parameters of the mattress negatively, furthermore taking into account the existence of hollow volumes and this transportation of thermal energy being consistent over an extended period of time.

It was found that paddings generally incorporate hollow volumes. These might be large hollow volumes as created by springs or small hollow volumes as found in all polyurethane foams. These hollow volumes store excessive thermal energy and only release them slowly over time, as they contain air, which releases excessive thermal energy slowly. The invention describes a method to remove that excessive thermal energy in those hollow volumes.

To achieve this, a material with a high thermal conductivity is used in a complete different way than previously. Instead of blending material with high thermal conductivity into the whole padding it is proposed to manufacture a band with high thermal conductivity, this band having a good mechanical flexibility. This band being able to transport thermal energy is placed in a very specific way into the mattress. It should be noted that only by placing the band as claimed and described in this document a consistent flow of thermal energy is achieved. Just placing the band any different into a mattress will not work. It had been observed that the placement of this band has to be done carefully, knowing very well the distribution of thermal energy within the hollow volumes of a padding to achieve satisfying results. It should be noted that the distribution of thermal energy in the hollow sections within a padding (for example a padding for a mattress) must be analyzed during use (during impact of body heat) and for an extended period of time. The band must be placed so that it touches sections with hollow volumes within the mattress with higher thermal energy (most likely just below the body of the user) and running uninterrupted to a section of the mattress with hollow volumes without higher thermal energy. The band described in this invention incorporates a layer of electrically conducting material, this layer itself also being uninterrupted or in other words continuous. Any interruption of the electrically conducting layer or the band itself will prohibit the band to work thermally. The only exception to this rule would be puncturing or perforating the band carefully, this is not reducing the thermal effect as has been found. This invention describes further variation of use, especially meaningful combination of the invention with other thermally effective methods previously known.

SHORT DESCRIPTION OF THE FIGURES

DETAILED DESCRIPTION OF THE INVENTION

Figure 1:
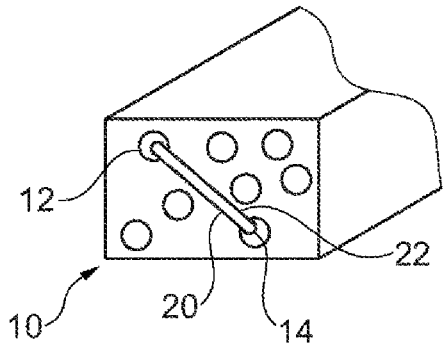
FIG. 1 shows a first embodiment of a padding in a schematic illustration.

In the following aspects of the invention will be described in more detail referring to preferred embodiments as illustrated in the figures. The following description is for illustrative purposes, only and is not intended to restrict the scope of protection as defined by the appended claims. Features shown in one embodiment may be combined with features of other embodiments and the person skilled in the art will appreciate, that the illustrated embodiments are merely provided for a better understanding of the inventive concept.

In the following a mattress as an embodiment of the padding according to the present invention will be described in more detail. The thermal comfort of a mattress is critical to obtaining a comfortable experience. There is a growing trend in the mattress industry to employ new materials which create a cooling effect for users with the use of innovative phase change materials (PCMs) or cooling gels included in the near-surface foam of a product. These materials seek to alleviate overheating during use or provide a more comfortable environment for those who may suffer from medical conditions which cause excess heat production.

The comfortable temperature window during sleep is relatively narrow as the body must try to maintain its core body temperature of 98.6 F (or 37° C.). Haex reports that the optimal insulating sleep system should ensure a bed temperature between 28° C. and 32° C. which should allow the contact temperature between the body and bed to stabilize between 30° C. and 35° C. Too high of a bed insulation will result in temperature rise which leads to excessive sweating and an increase in relative humidity. On the other hand, if insulation is too low, the body will cool off which may cause shivering and similar issues with sleep disturbance. These insulating properties are mainly dependent on the core materials and design. Cores made out of latex or PU for instance, will carry higher insulation values than a spring mattress. Aside from the core, the contact temperature itself is mainly dependent on the top layer and its ability to hold air.

There are not many solutions to this challenge for designing a mattress. Since 'feeling hot' is a feel of temperature, designers are looking for methods to reduce temperature. They are looking for 'cooling'—may it be active or passive. This leads to solutions with an air conditioner combined with a mattress, with ventilators, materials with high thermal connectivity blended into foam or with channels cut into foam materials running along the mattress. These methods are either expensive (air conditioner), noisy (ventilator) or not working at all (blending thermal conductive materials into foam, channels).

The main problem is that product designers see temperature as the parameter to be changed, so they end up with 'cooling' materials or methods. But temperature is only the result of the change of other parameters and not an elemental parameter by its own. The temperature of any material is the result of $$T_{(Mat@t)}=T_{(Mat@t-1)}+E_{(therm\text{-}inflow)}-E_{(therm\text{-}outflow)}$$

With $T_{(Mat@t)}$ being the Temperature of a given material at a given time, $T_{(Mat@t-1)}$ being the Temperature of this material before this given time, $E_{(therm\text{-}inflow)}$ being the thermal energy reaching the material between t−1 and t and $E_{(therm\text{-}outflow)}$ being the thermal energy leaving the material between t−1 and t. Based on this assumption a change of the temperature is not done by changing the temperature of the material itself but rather analyzing and optimizing the thermal energy flows effecting the materials.

In analyzing the thermal energy flows within a mattress, most product designers assume that thermal energy moves upward, like warm air, which rises if within cooler air. But as this invention teaches this assumption is not helping to design a mattress having superior thermal properties. It is true that warmer air rises within cooler air, but this only effect air. It is not directly the thermal energy itself which rises, but the physical effect that air with a higher level of thermal energy is lighter than air with a lower level of thermal energy. As air molecules can slide past each other easily, as the density of air is gaseous, the lighter air will have the tendency and capability to rise above the heavier air. But thermal energy itself has no weight and there is no gravity involved in moving thermal energy. Also helping warmer air to move upwards would only get the elevated thermal energy closer to the user instead of further away, as the user will in most cases lie on top of the mattress. But any method to reduce temperature should move thermal energy away from the user—not towards him.

Taking above mentioned formula, in order to lower the temperature in a material you either have to lower the inflow of thermal energy or raise the outflow. In a typical mattress, most inflow of thermal energy is from the impact of body heat. The body during sleep emits a heat flux of 40 W/qm skin, approx. 70-80 W/person which translates to an influx of 230 kJ per night. Additional influx of thermal energy can be heating devices used, or thermal energy used in conjunction with dynamic foams. There is no realistic method to reduce the inflow of thermal energy into a mattress, and the quantity of this inflow is obviously high.

The invention raises the outflow of thermal energy within a mattress. It uses materials itself flexible, so they can be incorporated in a mattress without reducing the comfort feeling. The invention is not using energy and is not transporting the excessive thermal energy upwards as warmer air would do. Therefore, the invention can be used to transport excessive thermal energy to the side or bottom of a mattress or to any section not felt by the user.

The invention utilizes a property of modern—mostly foam based—mattresses that thermal energy is not distributed evenly within the product. Old innerspring mattresses had a very open air-filled space within and around the springs. Thermal energy could move freely within the mattress therefore distributing excessive thermal energy from the body heat to sections of the body with less impact of body heat and therefore, the excessive thermal energy could not be felt by the user. But modern foam-based mattresses are very different in this respect. Polyurethane foam typically has many hollow volumes (usually called cells), which are either open (connected to each other) or closed (not connected to each other). These hollow volumes contain air, which gradually is becoming warmer with use. Even with open cell foams the movement of this air is very restricted and also air would move upwards towards the user, but not away from him. Besides the air as a transport medium for thermal energy within the mattress the foam material itself could be a transport medium for thermal energy. But foam has a low thermal conductivity. Foam material cannot transport thermal energy very well or rather not at all. There are solutions to blend material with a higher thermal conductivity with foam, so that the material can transport thermal energy away from the body. But these blended materials cannot transport thermal energy as the molecule chains with higher thermal conductivity are usually interrupted by molecule chains of Polyurethane stopping thermal energy flow. So, the molecule chains blended into foam can absorb some but not transport the excessive thermal energy. As mattresses are used for long periods up to 10 hours thermal energy must be transported away and not only absorbed.

This is also the reason why PCM's (Phase Change Material) are not effective in mattresses. The PCM will absorb some thermal energy (i.e. 9 KJ/m2) but by far not the 230 kJ emitted during a typical night.

Therefore, this invention is not absorbing thermal energy from the air within the hollow volumes but effectively transporting it to sections with hollow volumes where it is not felt by the user or to the outside air. The form factor of the invention is a band, as this is a form which is flexible in both dimension. Even though an electrically conducting layer is used in the invention a band is usually bended only in one direction (along the length) as the width is too short to bend the material. A band can also affect larger sections within a mattress, as several bands can be used with distance between it, so that moisture or humidity can pass easily between the bands.

The band has an electrically conducting layer and has therefore a high thermal conductivity. This parameter is not enough to really transport thermal energy, but it is necessary for function. Usually materials with carbon content are preferred, like graphite, but also other material, such as but not limited to copper or aluminum, could be used. To achieve some kind of flexibility the thickness of the electrically conducting layer needs to be reduced to below 0.5 mm, but higher thickness is also allowed in this invention as long as a certain flexibility is achieved.

This electrically conducting layer within the band has to be uninterrupted, meaning thickness, composition and width need to be above the minimum values along the whole length of the band. This condition is most important. Only by connecting the electrically conducting layer based on this principle a consistent flow of thermal energy can be observed in case also the following condition is met.

The last condition is the positioning of the band in a way that it touches the hollow volumes in section with excessive thermal energy i.e. direct under the body or any heating device and at the same time also touches uninterrupted at least one hollow volume in a section with normal or reduced thermal energy. These sections can be found in any mattress.

The sections of lower thermal energy are the left and right side of the mattress, or the feet portion. If the mattress is placed on a surface allowing air to reach the lower side of a mattress (i.e. slated frame, spring box) also this lower side can be used. There are two principles governing this invention.

1. The higher the difference of thermal energy content between both sections the better the thermal energy flow. As the thermal energy below the body is rather fixed it is worthwhile to search for section with lower thermal energy carefully. Some of the variations described below are based on lowering the thermal energy level in those sections.

2. The larger the section of the band is in a section of the mattress with lower thermal energy content in relation to the section of the band in a section of the mattress with excessive thermal energy the better the thermal energy flow. Therefore, the invention recommends that at least 30% of the band is in a section with lower thermal energy, but 50% would be preferred, especially if the temperature difference is not really large.

Figure 7:
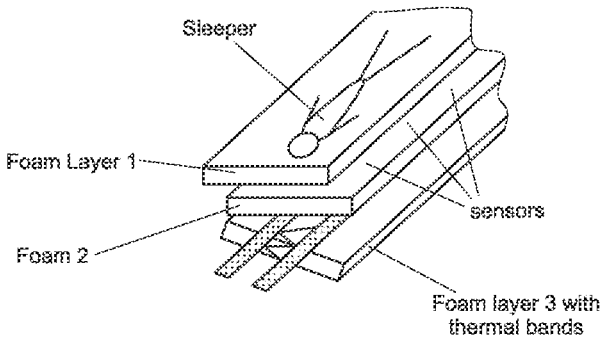
FIG. 7 shows the test set up of a test described.

The effects of this invention can be clearly measured. FIG. 7. Describes a test setting used. A sleeper was placed on a mattress containing a padding with the bands having a continuous electrically conducting layer. The bands were running along the length of the mattress. Three foam layers were placed on each other, being foam layer 1 on top, foam layer 2 in the center and foam layer 3 at the bottom of the mattress. The bands were placed between layer 2 and 3. Temperature sensors were placed around two locations, one being the hip zone on top of foam layer 1 just beneath the body, the other being the hip zone between layer 1 and 2. So the sensors were between body and the bands which were positioned one layer below. Temperature values were taken for every minute during a full night with a sleeper sleeping on top. Tests were done with the test setting described above, a test setting without the thermal bands, a test setting were the foam layer 1 was gel-infused foam (with and without the bands). The tables in FIG. 8 to FIG. 10 show the delta temperature values comparing always two test settings with each other.

Figure 8:
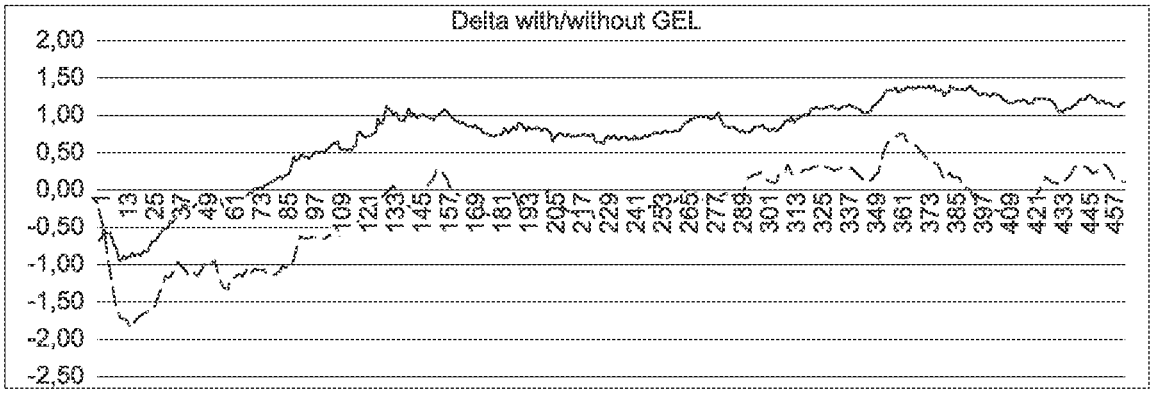
FIG. 8 shows the test results comparing settings with and without gel-infused foams

FIG. 8 compares a setting with conventional foams to a setting where the layer 1 is made of gel-infused foams. The upper solid line are the average delta values of the sensors atop foam layer 1, the lower dotted line the average delta values of sensors between foam layer 1 and 2. The x-axis is minutes, the y-axis is delta Temperature in Kelvin. Negative values denote that the gel-infused foam has lower temperature values compared to the conventional foam mattress. The result demonstrates that the gel-infused foams indeed lead to lower temperature values compared to conventional foam—but only in the first hour. After that time the thermal capacity of gel is filled, and temperature rises again. Temperature values after two hours are even higher with gel-foam compared to conventional foam.

Figure 9:
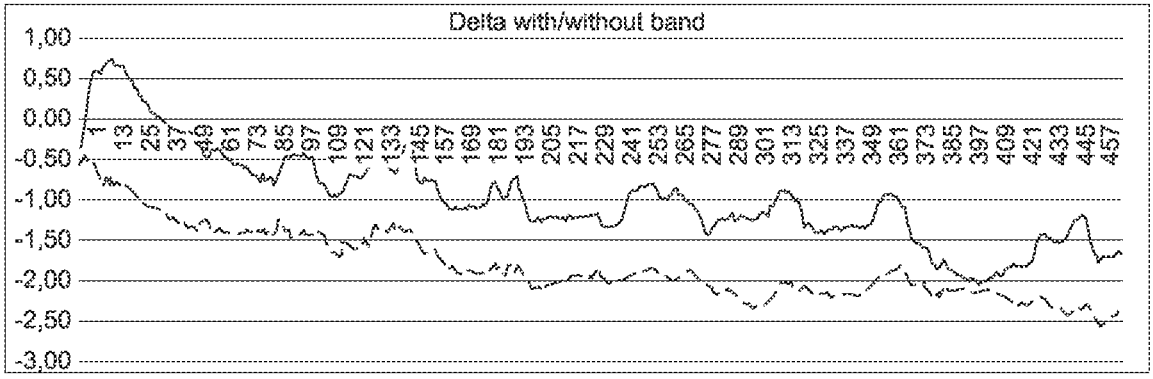
FIG. 9 shows the test results comparing settings with and without flexible bands

FIG. 9 compares a setting with conventional foam with flexible bands to a setting where the conventional foams do not contain the flexible bands. The upper solid line are the average delta values of the sensors atop foam layer 1, the lower dotted line the average delta values of sensors between foam layer 1 and 2. The x-axis is minutes, the y-axis is delta Temperature in Kelvin. Negative values denote that the foam with the bands below has lower temperature values compared to the conventional foam mattress without bands. It can be seen that apart from a small increase of temperature in the beginning the values are much lower with the bands than without through the full night. The effect increases even with time, as the normal foam mattress becomes warmer. The effect is significant with −2° K after 6 hours.

Figure 10:
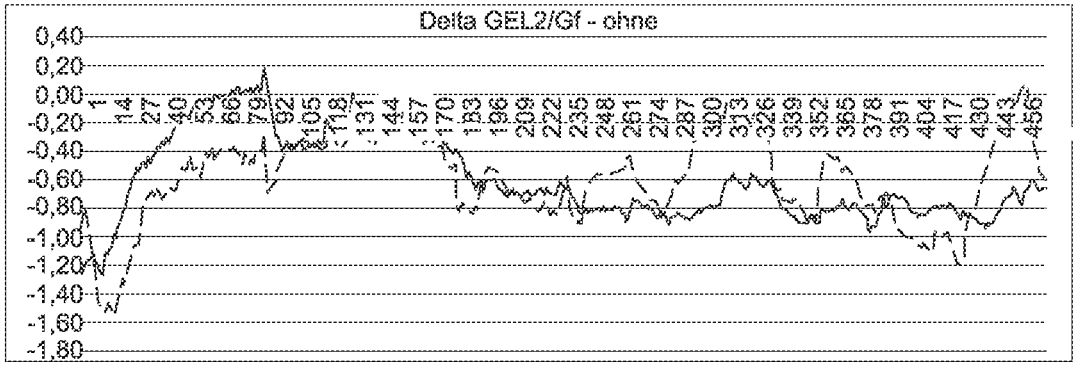
FIG. 10 shows the test results comparing settings with gel infused foams and with and without flexible bands.

FIG. 10 compares two settings both with layer 1 being made of gel-infused foams with one setting containing the flexible band and the other setting not containing flexible bands. The upper solid line are the average delta values of the sensors atop foam layer 1, the lower dotted line the average delta values of sensors between foam layer 1 and 2. The x-axis is minutes, the y-axis is delta Temperature in Kelvin. Negative values denote that the foam with the bands and the Gel-infused foam has lower temperature values than the conventional mattress. Table 3 shows that both effects, the immediate one of gel-infused foam and the long-term one of the bands described in this invention can be combined. The resulting mattress is cooler in the beginning and throughout the night. The offset is that the temperature lowering effect of the bands is reduced by the gel-infused foam.

The band itself is small and therefore not a blockade to humidity passing through the mattress. But if the humidity should pass through the band this can be punctured well with holes in regular patterns. The thermal energy flow will pass around these holes and not be interrupted. The puncture can be so dense that it is similar to a perforation which is also allowed within this invention. It is recommended to keep the holes as small as possible.

A band being flexible and consisting purely from electrically conducting material will typically be sensitive to punctual impact and react with break. The break should be especially avoided as this creates an interruption of thermal energy flow. It has been found that a laminating of a very thin PE layer (<0.18 mm thickness) is enough to prevent a break of the band. This lamination can of course also be applied on both sides but usually this is not necessary. Also, other material adding stability can be applied as long as it is flexible i.e. Polyurethane.

The band connecting the two sections with excessive and lower thermal energy can pass through or end in a section of the mattress filled with gel infused foam. Gel infused foam ("Gelfoam") is usually used to prevent the user from feeling too hot, so it answers a similar question. But typically, the invention described in this document creates a much higher thermal energy flow than gel infused foam. This combination adds up the thermal capabilities of the gel infused foam and of the band described in this document.

A further variation is based on the observation that the thermal energy level in the section with lower thermal energy should be as low as possible. It might be that based on the specific shape of the mattress even this section is penetrated by thermal energy from the body. So, any thermal shield (insulating layer) between said section and the body would lower the thermal energy level in that section, increases the thermal energy difference between said section and the section of excessive thermal energy and therefore increases flow of thermal energy within the band.

The band can be positioned purely within the mattress, but it can also be positioned that the band runs from the section of excessive thermal energy outside the body, i.e. along a side or the lower side of the mattress or completely outside (i.e. from the mattress into a spring box below). Typically, the outside thermal energy level is determined by room temperature this temperature being much lower than the temperature of sections of excessive thermal energy. It could be observed that this difference in thermal energy level is large enough to create a superior flow of thermal energy through the band. A section of the band of 20% outside the mattress or along the side of the mattress is more than enough to increase the flow of thermal energy to an optimal value.

The band described should have a thickness between 0, 1 mm to 0.5 mm. A thin band is more flexible but also more sensitive to break whereas a thicker band is the opposite. Also, the capacity of the band to absorb and transport thermal energy can be affected by the thickness of the band.

The band was observed to fit well into a mattress if the width is between 4 cm to 10 cm, though also smaller or wider dimensions are allowed. In case wider dimensions are used the puncturing or perforating variation is preferred as not to reduce humidity flow within the mattress.

Most superior thermal effect of the band was observed when using graphite as the electrically conducting layer of choice. As graphite comes in very different variations good results were achieved using graphite with a carbon content greater than 99% and/or a content of ash lower than 1% and/or a density of greater than 1 g/qcm and/or a content of Sulphur lower than 1.800 ppm.

Also, there are very different types of graphite available. The type called highly oriented pyrolytic graphite (HOCG) is very capable to transport thermal energy based on the special molecular structure. Highly oriented pyrolytic graphite (HOPG) is a highly pure and ordered form of synthetic graphite. It is characterized by a low mosaic spread angle, meaning that the individual graphite crystallites are well aligned with each other. The best HOPG samples have mosaic spreads of less than 1 degree. It had been found that this graphite type is generating very good results in transporting thermal energy.

In another version of the invention the electrically conducting layer is made from graphene. This material has an allotrope of carbon in the form of a two-dimensional, atomic-scale, hexagonal lattice in which one atom forms each vertex. It is the basic structural element of other allotropes, including graphite, charcoal, carbon nanotubes and fullerenes. It can also be considered as an indefinitely large aromatic molecule, the ultimate case of the family of flat polycyclic aromatic hydrocarbons. As graphene has a thermal conductivity of greater than 1,000 W/mK it can be much smaller than a flexible band with an electrically conducting layer of normal graphite having with the same thermal performance.

Embodiments

FIG. 1 demonstrates the general concept of the invention. A padding 10 is illustrated having several hollow volumes 12 and 14. Usually such a padding 10 will be partly occupied by a user and a thermal gradient can be present within the padding. Under such a situation it is possible that some of hollow volumes contain excessive thermal energy 12 some not 14. In the illustrated embodiment a flexible band 20 having a continuous electrically conducting layer 22 is extending such that it extends into at least two hollow volumes such that a thermal gradient can be smoothened. Although the band 20 is illustrated as ending in one hollow volume, respectively it is to be noted that the band may as well extend beyond them, provided that the extension is at least such that several or at least two of the hollow volumes 12, 14 are connected with each other, allowing thermal energy transfer beyond the limits of one single hollow volume or preferably from one hollow volume towards another hollow volume. The electrically conducting band 20 is thus provided and configured for allowing to improve a padding having sections, each covering at least one hollow volume of the padding. Indeed, the band 20 is flexible and elongated for transferring thermal energy from a first section with hollow volumes in the event of excess thermal energy towards at least one second section with hollow volumes in the padding not containing excess thermal energy. Since the band is having a continuous electrically conducting layer with a defined area extending from at least one first section to another different second section a thermal gradient within the padding can be smoothened and the comfort for a user using such a padding can be drastically improved without substantially impairing other comfort characteristics of the padding. One of the main advantages is that the band is a passive thermal element not requiring any additional elements such as a power supply, a fluid driving device or the like. Since the band is preferably extending such as to extend from or beyond at least one hollow volume in a first section to or beyond another hollow volume in another section thermal energy can be easily transferred between the respective sections and preferably as well between the respective hollow volumes. It is to be noted that in practice a section will include a multitude of hollow volumes. It is furthermore to be noted that the invention is not excluding that one or more hollow volumes may extend in either section.

Figure 2:
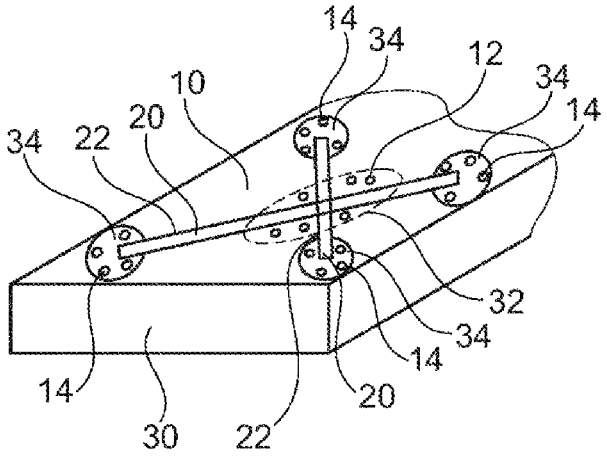
FIG. 2 shows a second embodiment of a padding in a schematic illustration.

FIG. 2 shows a possible configuration of the invention. A mattress 30 contains a padding 10. Within the padding 10 is a section of excess thermal energy 32, e.g. the section where the hip of a sleeper is located. Therefore, this section has several hollow volumes also containing excessive thermal energy 12. The edges of the mattress 30 and therefore padding 10 are not affected by the body of a sleeper and the emittance of thermal energy. Therefore, these edges are sections without excessive thermal energy 34 and will have one or more hollow volumes without excessive thermal energy 14. Two bands 20 having a continuous electrically conducting layer 22 are positioned crossing each other at the section with excess thermal energy 32. Both bands 20 are running from edge to edge connecting at least one section including a first hollow volume with excess thermal energy 12 with at least a second section including at least another hollow volume without excess thermal energy 14. Using such a configuration allows improved thermal dissipation as crossing bands are used. The double layer in section 32 with hollow volumes 12 with excess thermal energy has two bands 20 to absorb excess thermal energy and four different directions to transport this energy. The section (34) with hollow volumes (14) with the lowest thermal energy load will generally receive the most thermal energy in a configuration like this, with positive effect on thermal efficiency.

Figure 3:
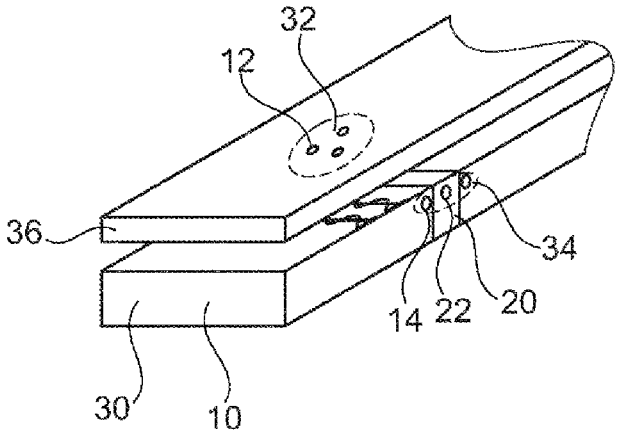
FIG. 3 shows another embodiment of a padding in schematic illustration.

FIG. 3 shows as another embodiment of the inventive padding a mattress 30 having a top layer 36 made from foam and a padding 10 filling the lower section of the mattress 30. The section with excess thermal energy 32 having hollow volumes with excess thermal energy 12 would be most probable in the center of the mattress 30. The band 20 with a continuous electrically conducting layer 22 runs through the padding 10 to the outside of the mattress 30 and continues along the side. This side—not affected by body heat will most likely be a section having hollow volumes 14 without excess thermal energy or be a section without excess thermal energy 34 having hollow volumes without excess thermal energy 14. The band 20 connects both sections 32, 34.

Figure 4:
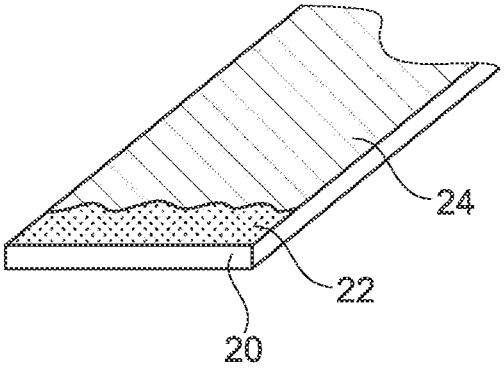
FIG. 4 shows the flexible band with a laminating layer.

FIG. 4. shows a band 20 having a continuous electrically conducting layer 22 being laminated by a PE-layer 24 along the whole length and width of said band to stabilize the electrically conducting layer 22. Such a band may be implemented in the previous embodiments.

Figure 5:
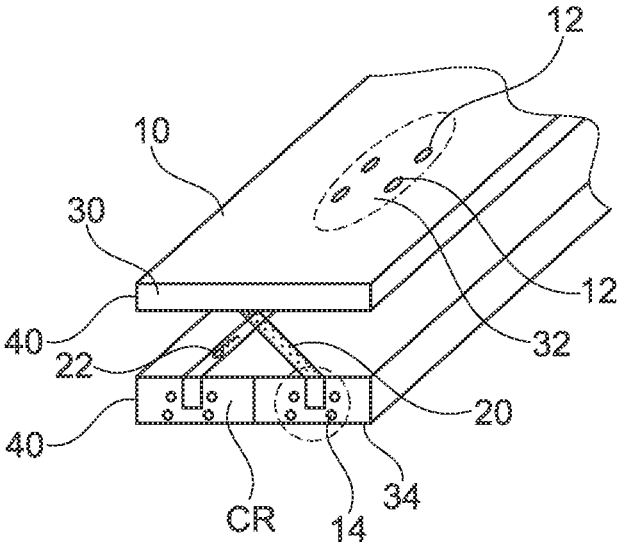
FIG. 5 shows another embodiment in a schematic illustration.

FIG. 5. shows a full bed 40 made from a Box spring base 42 and a mattress 30 having a padding 10. It is assumed that both parts 30, 42 are fixed together. The section with excess thermal energy 32 containing hollow volumes with excess thermal energy 12 is located in the center of the mattress 30. Two bands 20 having an electrically conducting layer 22 are running across the padding 10 of the mattress 30, continuing to inner sections of the base 42. This base—being far away from the body—is most likely having at least one section without excess thermal energy 34 with at least one hollow volume without excess thermal energy 14. By correctly positioning the bands 20 runs through both sections 32, 34 connecting them with each other.

Figure 6:
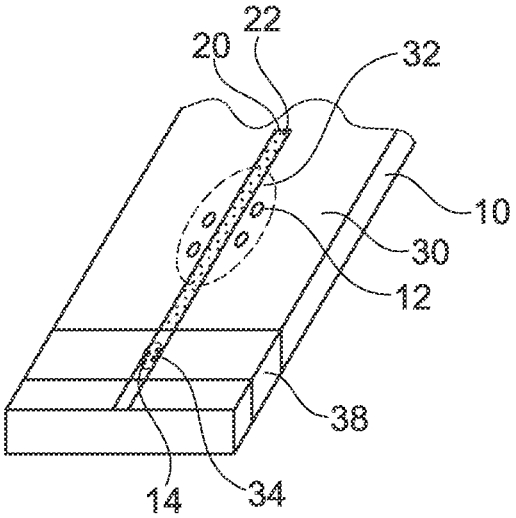
FIG. 6 shows another embodiment in a schematic illustration.

FIG. 6. shows a mattress 30 having a section made from gel-infused foam 38 being part of a padding 10. The band 20 having a continuous electrically conducting layer 22 runs through a section with excess thermal energy 32 having hollow volumes with excess thermal energy 12 through the section made from gel-infused foam 38 this section being the section without excessive thermal energy 34 having hollow volumes without excess thermal energy 14.

FIG. 7 shows the test situation used to elaborate the further below description for demonstrating the benefits of the invention as described above.

FIG. 8 shows the differences in temperature values during a night loaded with a human body comparing a foam padding partly consisting of gel infused foam to a foam padding not using gel-infused foam.

FIG. 9 shows the differences in temperature values during a night loaded with a human body comparing a foam padding using the electrically conducting bands to a foam padding not using electrically conducting bands.

FIG. 10 shows the differences in temperature values during a night loaded with a human body comparing a foam padding partly consisting of gel-infused foam using the electrically conducting bands to a foam padding partly consisting of gel-infused foam not using electrically conducting bands.

REFERENCES NUMERALS

10 Padding
12 First hollow volume (with excess thermal energy)
14 Second hollow volume (without excess thermal energy)
20 Flexible Band
22 Electrically conducting layer on flexible Band
24 Lamination on flexible Band
30 Mattress
32 Section with excessive thermal energy
34 Section without excessive thermal energy
36 Top Foam Layer of a mattress
38 Section of mattress with Gel-infused foam
40 Bed
42 Box spring base of a Bed

What is claimed is:

1. A foam padding having sections, each covering at least one hollow volume of the padding, said padding including a flexible elongated uninterrupted band for transferring thermal energy from at least one hollow volume in a first one of said sections in the event of excess thermal energy towards at least one hollow volume in a second section in the padding not containing excess thermal energy, said band having a continuous electrically conducting layer with a defined area extending from the first section to another different second section, wherein the second section is located at an edge of the padding, and wherein the at least one hollow volume of each of the first section and the second section is formed as an open-cell foam.

2. The foam padding according to claim 1, wherein said band is positioned such that at least 30% of the defined area is positioned outside of the first section.

3. The foam padding according to claim 2, wherein the first section is a section prone to be warmer than said second section and/or prone to be used for supporting a human body or a part of a human body, whereas the second section isn't, wherein said band has dimensions of at least 4 cm in width and/or at least 25 cm in length, wherein said sections are dimensioned to cover at least a surface of the padding corresponding to 0.08 $m^2$ or 10% of the overall surface, and wherein said band is punctured and/or perforated.

4. The foam padding according to claim 3, wherein said band is laminated on one or both sides with polyethylene (PE), polyurethane (PU) or other stabilizing materials, wherein the foam padding further comprises at least one section with gel-infused foam wherein said band extends through said at least one section with gel-infused foam, wherein the foam padding further comprises at least one insulating layer, and wherein the band is arranged such that at least 20% of the defined area is exposed or outside of the padding.

5. The foam padding according to claim 1, wherein the first section is a section prone to be warmer than said second section and/or prone to be used for supporting a human body or a part of a human body, whereas the second section isn't.

6. The foam padding according to claim 1, wherein said band has dimensions of at least 4 cm in width and/or at least 25 cm in length.

7. The foam padding according to claim 1, wherein said sections are dimensioned to cover at least a surface of the padding corresponding to 0.08 $m^2$ or 10% of the overall surface.

8. The foam padding according to claim 1, wherein said band is punctured and/or perforated.

9. The foam padding according to claim 1, wherein said band is laminated on one or both sides with polyethylene (PE), polyurethane (PU) or other stabilizing materials.

10. The foam padding according to claim 1, comprising at least one section with gel-infused foam wherein said band extends through said at least one section with gel-infused foam.

11. The foam padding according to claim 1, wherein the band is arranged such that at least 20% of the defined area is exposed or outside of the padding.

12. The foam padding according to claim 1, wherein the band is 0.1 mm to 0.5 mm thick and/or has a width of 4-10 cm.

13. The foam padding according to claim 1, wherein the electrically conducting layer is made from graphite.

14. The foam padding according to claim 13, wherein the graphite has a carbon-content greater than 99%, and the band has a content of ash lower than 1% or is highly oriented pyrolytic graphite (HOCG).

15. The foam padding according to claim 1, wherein the band is having density greater 1 $g/cm^3$.

16. The foam padding according to claim 1, wherein the electrically conducting layer has a content of sulfur lower than 1800 ppm.

17. The foam padding according to claim 1, wherein the electrically conducting layer is made of graphene.

18. The foam padding according to claim 1, wherein the padding is a mattress.

19. The foam padding according to claim 1, wherein the flexible elongated uninterrupted band extends from the first section towards the second section, and is configured to be arranged under a human body.

20. The foam padding according to claim 1, wherein the at least one hollow volume of each of the first section and the second section comprises a plurality of hollow volumes.

21. A foam padding having sections, each covering at least one hollow volume of the padding, said padding including a flexible elongated uninterrupted band for transferring thermal energy from at least one hollow volume in a first one of said sections in the event of excess thermal energy towards at least one hollow volume in a second section in the padding not containing excess thermal energy, said band having a continuous electrically conducting layer with a defined area extending from the first section to another different second section, wherein the second section is located at an edge of the padding, and wherein the at least one hollow volume of each of the first section and the second section is formed as a closed-cell foam.

22. The foam padding according to claim 21, wherein the flexible elongated uninterrupted band extends from the first section towards the second section, and is configured to be arranged under a human body.

23. The foam padding according to claim 21, wherein the at least one hollow volume of each of the first section and the second section comprises a plurality of hollow volumes.

* * * * *